US009342016B2

(12) United States Patent
Shimada

(10) Patent No.: US 9,342,016 B2
(45) Date of Patent: May 17, 2016

(54) IMAGE FORMING APPARATUS AND IMAGE FORMING SYSTEM

(71) Applicant: KYOCERA Document Solutions Inc., Osaka (JP)

(72) Inventor: Akira Shimada, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 14/869,281

(22) Filed: Sep. 29, 2015

(65) Prior Publication Data

US 2016/0091848 A1 Mar. 31, 2016

(30) Foreign Application Priority Data

Sep. 30, 2014 (JP) ..... 2014-200508

(51) Int. Cl.
*G03G 15/00* (2006.01)

(52) U.S. Cl.
CPC ..... *G03G 15/50* (2013.01)

(58) Field of Classification Search
CPC ..... G03G 15/50
USPC ..... 399/257, 27, 101
See application file for complete search history.

(56) References Cited

U.S. PATENT DOCUMENTS 9,229,399 B2 * 1/2016 Kamihara ..... G03G 15/50

FOREIGN PATENT DOCUMENTS

JP 2011-059454 A 3/2011

* cited by examiner

*Primary Examiner* — Quana M Grainger
(74) *Attorney, Agent, or Firm* — Studebaker & Brackett PC

(57) ABSTRACT

An image forming apparatus includes a printing section, a storage section, and a control section. The printing section prints a toner image on paper. The storage section stores prescribed image data for which printing is permitted using disposal-scheduled toner that is scheduled for disposal as waste toner. The control section determines whether or not a preset disposal condition is satisfied. Upon determining that the disposal condition is satisfied, the control section determines whether or not prescribed image data is stored in the storage section. Upon determining that prescribed image data is stored in the storage section, the control section sets the operating mode of the printing section as a waste toner reduction mode in which the printing section uses the disposal-scheduled toner to perform printing based on the prescribed image data.

8 Claims, 6 Drawing Sheets

IMAGE FORMING APPARATUS AND IMAGE FORMING SYSTEM

INCORPORATION BY REFERENCE

The present application claims priority under 35 U.S.C. §119 to Japanese Patent Application No. 2014-200508, filed on Sep. 30, 2014. The contents of this application are incorporated herein by reference in their entirety.

BACKGROUND

The present disclosure relates to an image forming system and an image forming apparatus including a developing device that develops electrostatic latent images into toner images.

One example of an image forming apparatus forms an electrostatic latent image on the surface of an image bearing member, develops the electrostatic latent image into a toner image, and transfers the toner image onto paper. An image forming apparatus such as described above includes a developing device. The developing device contains toner and charges the toner by, for example, stirring the toner. The developing device supplies the toner to the electrostatic latent image formed on the surface of the image bearing member, and thereby develops the electrostatic latent image into the toner image.

In the above configuration, toner has a greater tendency to deteriorate (for example, become excessively charged) in a situation in which the amount of toner supplied to the image bearing member from the developing device (referred to below as a toner supply amount) is small—that is, the amount of toner in the developing device that is consumed (referred to below as a toner consumption amount) is small. As a result, a greater proportion of the toner contained in the developing device is in a deteriorated state.

In consideration of the above, an image forming apparatus has been proposed that performs enforced discharge of toner in a developing device onto the surface of an image bearing member and that disposes of the toner subjected to the enforced discharge. The aforementioned image forming apparatus performs the enforced toner discharge onto a non-image region of a photosensitive drum that acts as the image bearing member. The discharged toner is removed from the non-image region of the photosensitive drum by a cleaning blade.

SUMMARY

An image forming apparatus according to the present disclosure includes a printing section, a storage section, and a control section. The printing section prints a toner image on paper and includes an image bearing member, a developing device, and a cleaning device. The image bearing member has a surface on which an electrostatic latent image is formed based on image data. The developing device supplies toner onto the surface of the image bearing member and develops the electrostatic latent image into the toner image. The cleaning device removes residual toner from the surface of the image bearing member. The storage section stores prescribed image data for which printing is permitted using disposal-scheduled toner that is scheduled for disposal as waste toner. The control section determines whether or not a preset disposal condition is satisfied. Upon determining that the disposal condition is satisfied, the control section determines whether or not prescribed image data is stored in the storage section. Upon determining that prescribed image data is not stored in the storage section, the control section sets an operating mode of the printing section as a toner disposal mode in which the developing device performs enforced discharge of the disposal-scheduled toner onto the surface of the image bearing member and the cleaning device removes the disposal-scheduled toner from the image bearing member. Upon determining that prescribed image data is stored in the storage section, the control section sets the operating mode of the printing section as a waste toner reduction mode in which the printing section uses the disposal-scheduled toner to perform printing based on the prescribed image data.

An image forming system according to the present disclosure includes a plurality of the image forming apparatuses described above. The image forming apparatuses are communicable with one another. The storage sections of the image forming apparatuses each store, as prescribed image data, data depicting the same image. Among the image forming apparatuses, an image forming apparatus for which the operating mode of the printing section therein is first set as the waste toner reduction mode performs printing based on the data depicting the same image and performs processing to delete data depicting the same image as the printed image from the storage sections of the other image forming apparatuses.

DETAILED DESCRIPTION

An embodiment of the present disclosure is explained using, as an example, a multifunction peripheral that has various functions such as a print function and a copy function.

<Multifunction Peripheral Overall Configuration>

Figure 1:
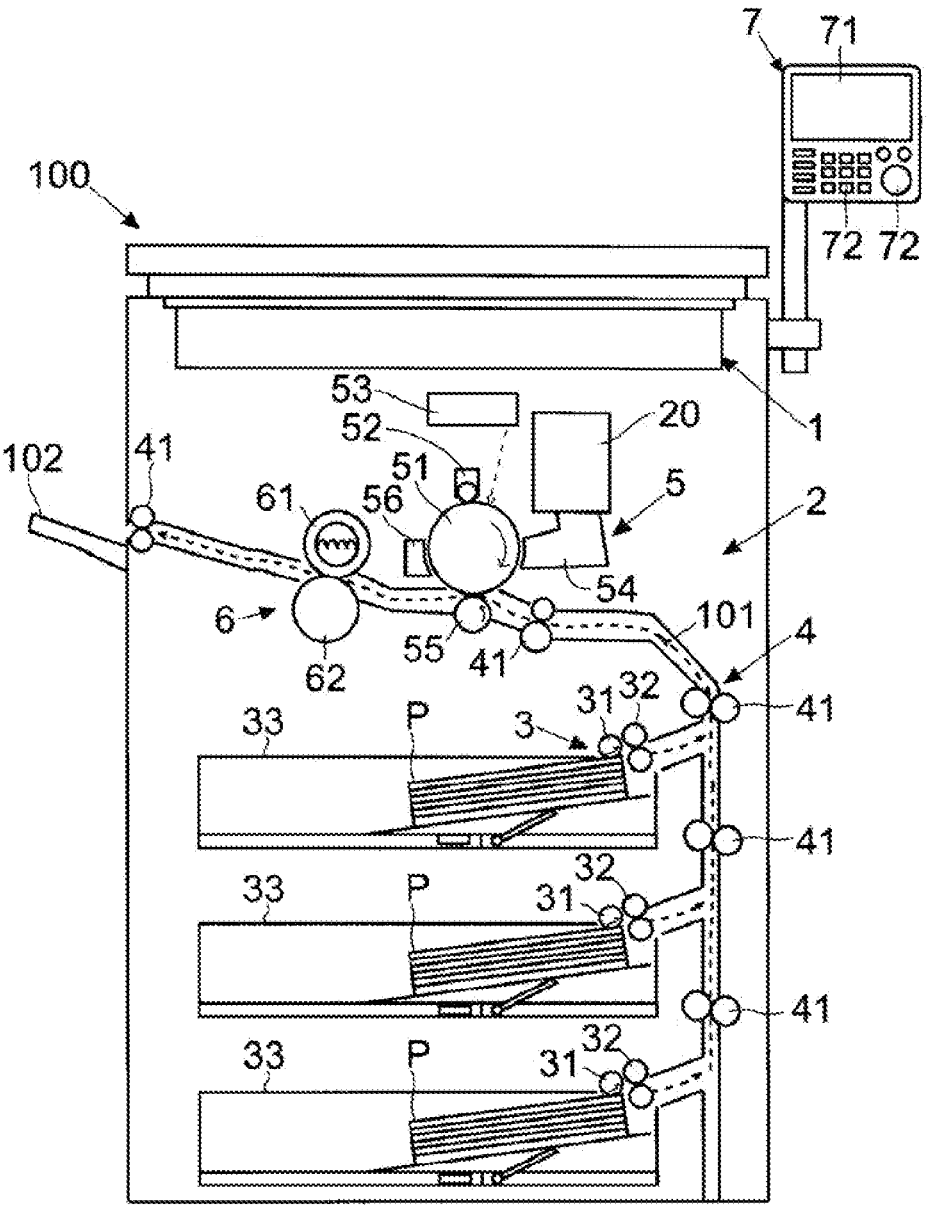
FIG. 1 is an overview diagram illustrating a multifunction peripheral according to an embodiment of the present disclosure.

A multifunction peripheral 100 (equivalent to the "image forming apparatus") illustrated in FIG. 1 includes an image reading section 1 and a printing section 2. The image reading section 1 generates image data by reading a document. The printing section 2 conveys paper P along a paper conveyance path 101. The printing section 2 also forms a toner image based on image data. The printing section 2 then prints the toner image onto the paper P while conveying the paper P and ejects the paper P onto an exit tray 102 once printing is complete.

The printing section 2 includes a paper feed section 3, a paper conveyance section 4, an image forming section 5, and a fixing section 6. The paper feed section 3 includes pickup rollers 31 and pairs of paper feed rollers 32. The paper feed section 3 feeds paper P loaded in paper feed cassettes 33 into the paper conveyance path 101. The paper conveyance section 4 includes pairs of conveyance rollers 41. The paper conveyance section 4 conveys paper P along the paper conveyance path 101.

The image forming section 5 includes a photosensitive drum 51, a charging device 52, a light exposure device 53, a developing device 54, a transfer roller 55, and a cleaning device 56. The photosensitive drum 51 is equivalent to the "image bearing member".

During image formation, the charging device 52 charges the surface of the photosensitive drum 51 as the photosensitive drum 51 rotates. The light exposure device 53 forms an electrostatic latent image on the surface of the photosensitive drum 51 by exposing the surface of the photosensitive drum 51 to light. The developing device 54 contains toner. The developing device 54 supplies the toner to the electrostatic latent image formed on the surface of the photosensitive drum 51, and thereby develops the electrostatic latent image into a toner image.

The transfer roller 55 is in pressed contact with the surface of the photosensitive drum 51 and forms a transfer nip therebetween. The toner image on the surface of the photosensitive drum 51 is transferred onto paper P as the paper P passes through the transfer nip. The cleaning device 56 removes residual toner and the like that remains on the surface of the photosensitive drum 51.

The fixing section 6 includes a heating roller 61 and a pressure roller 62. The heating roller 61 has an internal heat source. The pressure roller 62 is in pressed contact with the heating roller 61 and forms a fixing nip therebetween. The paper P onto which the toner image has been transferred is subjected to heat and pressure as the paper P passes through the fixing nip. Consequently, the toner image is fixed to the paper P, thereby completing printing.

The toner contained in the developing device 54 is consumed as a result of printing being performed. Therefore, it is necessary to replenish the toner in the developing device 54. A container 20 that contains toner for replenishing the developing device 54 is attached to the multifunction peripheral 100. The toner contained in the container 20 is supplied to the developing device 54 from the container 20 when the remaining amount of toner in the developing device 54 falls to below a preset threshold amount.

The container 20 is freely attachable to and detachable from a main body of the multifunction peripheral 100. For example, part of an apparatus cover of the multifunction peripheral 100 may be an openable cover (not illustrated). Opening of the openable cover exposes a space in which the container 20 is attached. When toner in a container 20 that is currently attached to the main body runs out (i.e., when the container 20 is empty), a user can replace the empty container 20 with a new container 20.

The multifunction peripheral 100 also includes an operation panel 7. The operation panel 7 includes a liquid-crystal display panel 71 equipped with a touch panel. The liquid-crystal display panel 71 displays messages and soft keys for receiving various settings. The liquid-crystal display panel 71 alternatively displays information indicating the status of the multifunction peripheral 100. The operation panel 7 includes hard keys 72 such as a start key and a numeric keypad.

Figure 2:
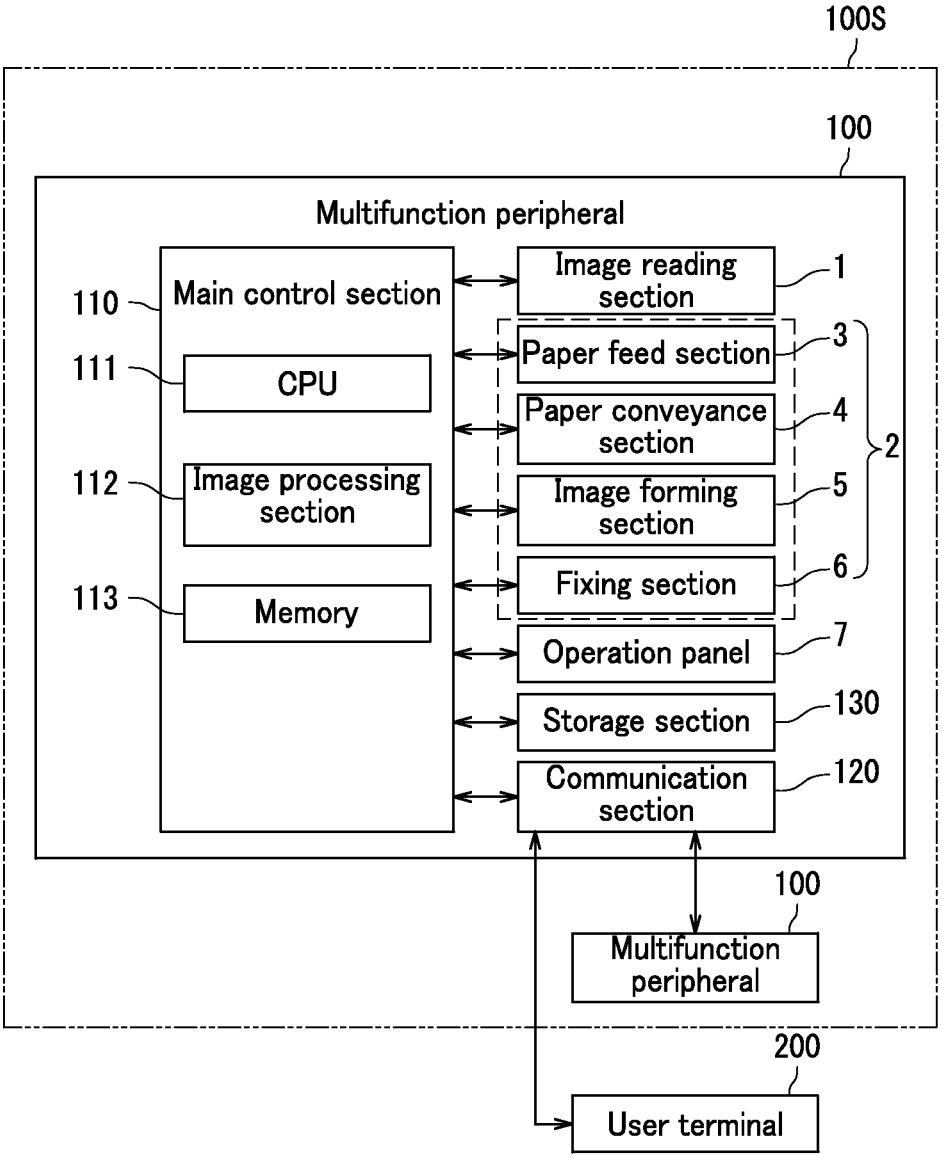
FIG. 2 is a block diagram illustrating hardware configuration of the multifunction peripheral according to the embodiment of the present disclosure.

As illustrated in FIG. 2, the multifunction peripheral 100 includes a main control section 110 (equivalent to the "control section"). The main control section 110 includes a CPU 111, an image processing section 112, and a memory 113. The image processing section 112 is for example an ASIC exclusively for image processing and performs image processing on image data (for example, enlargement/reduction, density conversion, and data format conversion). The memory 113 for example includes ROM and RAM, and stores a control program and data. The main control section 110 controls operation of the multifunction peripheral 100 based on the control program and the data stored in the memory 113.

More specifically, the main control section 110 is connected to the image reading section 1 and the printing section 2 (paper feed section 3, paper conveyance section 4, image forming section 5, and fixing section 6), and for example controls reading operation of the image reading section 1 and printing operation of the printing section 2. In the present embodiment, the multifunction peripheral 100 has a toner disposal mode, a waste toner reduction mode, and a normal printing mode. The printing section 2 operates in accordance with the aforementioned modes of the multifunction peripheral 100. The main control section 110 is also connected to the operation panel 7. The main control section 110 controls display operation of the operation panel 7 and detects operations performed on the operation panel 7.

The main control section 110 is also connected to a communication section 120 and a storage section 130. The communication section 120 is for example connected to a user terminal 200 via a communication network such as a LAN and performs communication with the user terminal 200. The user terminal 200 is a personal computer that is used by a user. The user terminal 200 for example transmits image data that is base data for a printed image. The communication section 120 is also communicably connected to another multifunction peripheral 100 (other device) via the communication network. A plurality of the multifunction peripherals 100 that are communicably connected to one another form an image forming system 100S.

The storage section 130 includes ROM and a HDD, and stores various data such as image data. The image data stored in the storage section 130 for example includes image data of a document obtained through reading of the document by the image reading section 1 and image data transmitted from the user terminal 200. In the present embodiment, the image data stored in the storage section 130 is base data for a printed image that is printed in the waste toner reduction mode.

<Toner Disposal Mode>

Toner contained in the developing device 54 is transported from a magnetic roller (not illustrated) to a development roller (not illustrated) while being stirred inside of the developing device 54. Some of the toner transported to the development roller detaches from the development roller and moves toward the surface of the photosensitive drum 51 (i.e., is consumed), while the remainder of the toner returns to inside of the developing device 54. During the process described above, the toner is subjected to physical and electrical stress. Consequently, toner tends to deteriorate if it remains in the developing device 54 for a long time. In other words, toner supplied into the developing device 54 is preferably consumed within a short time. However, only a small amount of toner is consumed in a situation in which printing is repeatedly performed with a low coverage ratio (ratio of printed pixels relative to the total number of pixels in one page). Consequently, toner tends to remain in the developing device 54 for a long time.

The main control section 110 determines whether or not a toner disposal condition is satisfied. (The toner disposal condition is referred to below simply as a disposal condition.) The disposal condition is preset as a condition for disposing of a portion of the toner contained in the developing device 54. Upon determining that the disposal condition is satisfied (i.e., in a situation in which printing is repeatedly performed with a low coverage ratio), the main control section 110 sets an operating mode of the printing section 2 as the toner disposal mode. When the operating mode of the printing section 2 is set as the toner disposal mode, enforced discharge of a portion of the toner in the developing device 54 is performed onto the surface of the photosensitive drum 51. The toner discharged onto the surface of the photosensitive drum 51 is removed from the surface of the photosensitive drum 51 by the cleaning device 56 and is disposed of as waste toner.

In some instances, the main control section 110 sets the operating mode of the printing section 2 as the waste toner reduction mode rather than the toner disposal mode upon determining that the disposal condition is satisfied. When the operating mode of the printing section 2 is set as the waste toner reduction mode, the printing section 2 performs printing using toner that is scheduled for disposal as waste toner (also referred to below as disposal-scheduled toner). Consequently, the amount of toner that is disposed as waste toner is reduced. Printing in the waste toner reduction mode is explained in detail further below.

The main control section 110 performs first counting processing in order to perform a determination of whether or not the disposal condition is satisfied. The first counting processing involves counting a printed sheet number in the normal printing mode once the multifunction peripheral 100 is started up (once the power of the multifunction peripheral 100 is turned on), starting from an initial point that is a time at which printing is first performed in the normal printing mode. Upon determining that the printed sheet number counted in the first counting processing (referred to below as a first counted sheet number) has reached a preset printed sheet number (referred to below as a first printed sheet number), the main control section 110 performs the determination of whether or not the disposal condition is satisfied. Although no particular limitations are placed on the first printed sheet number, the first printed sheet number is for example on the order of tens or hundreds of sheets (for example, 100 sheets).

The main control section 110 resets the first counted sheet number once the first counted sheet number reaches the first printed sheet number. The main control section 110 subsequently starts counting of a new printed sheet number (i.e., starts new first counting processing), starting from an initial point that is a time at which printing is first performed in the normal printing mode. The main control section 110 performs the determination of whether or not the disposal condition is satisfied once the first counted sheet number reaches the first printed sheet number. In other words, the main control section 110 performs the first counting processing repeatedly and performs the determination of whether or not the disposal condition is satisfied each time the first counted sheet number reaches the first printed sheet number.

During the determination of whether or not the disposal condition is satisfied, the main control section 110 obtains an average value (referred to below as a first coverage ratio) of coverage ratios of pages printed during the first counting processing up until the first printed sheet number is reached. The main control section 110 then determines whether or not the first coverage ratio is smaller than a first threshold value. When the first coverage ratio is smaller than the first threshold value, the main control section 110 determines that the disposal condition is satisfied (i.e., determines that printing has been repeatedly performed with a low coverage ratio) and sets the operating mode of the printing section 2 as the toner disposal mode. On the other hand, when the first coverage ratio is not smaller than the preset first threshold value, the main control section 110 determines that the disposal condition is not satisfied. In such a situation, the main control section 110 does not set the operating mode of the printing section 2 as the toner disposal mode or the waste toner reduction mode. Although no particular limitations are placed on the threshold value used as the determination criterion for whether or not the disposal condition is satisfied, the threshold value is for example on the order of several percent (for example, 5%). The threshold value may be adjustable.

<Waste Toner Reduction Mode>

When the operating mode of the printing section 2 is set as the waste toner reduction mode, the printing section 2 performs printing using disposal-scheduled toner. Consequently, the amount of toner that is disposed of as waste toner is reduced because the disposal-scheduled toner is used for printing.

In the waste toner reduction mode, the printing section 2 performs printing based on prescribed image data. The prescribed image data is pre-registered by a user as prescribed image data and is stored in the storage section 130. In other words, the prescribed image data is image data that the user has given permission for printing using the disposal-scheduled toner and is not image data that is meaningless to the user.

Printing based on the prescribed image data is not performed until the operating mode of the printing section 2 is set as the waste toner reduction mode. Therefore, image data for which printed matter is not immediately required is typically registered as prescribed image data. Alternatively, in a situation in which the multifunction peripheral 100 is installed in a store such as a convenience store, image data of an advertisement that is useful for users of the convenience store may be registered as prescribed image data.

Prescribed image data can be registered through direct operation of the multifunction peripheral 100. For example, a setting may be made for registering image data generated through reading of a document by the multifunction peripheral 100 as prescribed image data. Consequently, the image data of the document obtained through reading of the document is registered as prescribed image data. Prescribed image data can also be registered through the user terminal 200. For example, the user terminal 200 is used to select image data for registration as prescribed image data. The selected image data is transmitted from the user terminal 200 to the multifunction peripheral 100. Consequently, the image data selected using the user terminal 200 is registered as prescribed image data. Image data that is transferred to the multifunction peripheral 100 from portable memory, such as USB memory, can also be registered as prescribed image data.

Prescribed image data registered as described above is stored in the storage section 130. It should be noted that the prescribed image data stored in the storage section 130 may be a plurality of pieces of image data. Upon determining that the disposal condition is satisfied, the main control section 110 determines whether or not prescribed image data is stored in the storage section 130. In a situation in which the main control section 110 determines that prescribed image data is stored in the storage section 130, the main control section 110 sets the operating mode of the printing section 2 as the waste toner reduction mode. On the other hand, in a situation in which the main control section 110 determines that prescribed image data is not stored in the storage section 130, the main control section 110 sets the operating mode of the printing section 2 as the toner disposal mode. In other words, in the above situation, the disposal-scheduled toner is disposed of as waste toner (i.e., the disposal-scheduled toner is not used to perform printing).

When the operating mode of the printing section 2 is set as the waste toner reduction mode, the printing section 2 uses the disposal-scheduled toner to perform printing based on the prescribed image data. The main control section 110 selects one or more pieces of prescribed image data as a printing target from among the prescribed image data stored in the storage section 130 such that the amount of toner consumed by printing in the waste toner reduction mode (also referred to below as a toner consumption amount) is as close as possible to the amount of toner for which disposal is currently required (also referred to below as a disposal-scheduled toner amount). The main control section 110 instructs the printing section 2 to perform printing based on the prescribed image data that is selected as the printing target.

More specifically, the main control section 110 obtains a coverage ratio for each of one or more pieces of prescribed image data stored in the storage section 130. Based on the obtained coverage ratios, the main control section 110 calculates an amount of toner that would be consumed by performing printing based on one or more pieces of prescribed image data. The main control section 110 sets the disposal-scheduled toner amount based on the first coverage ratio. For example, the disposal-scheduled toner amount may be set as a larger value when the first coverage ratio is a small value. Alternatively, the disposal-scheduled toner amount may be preset.

The toner consumption amount for printing in the waste toner reduction mode does not need to exactly match the disposal-scheduled toner amount. In other words, the toner consumption amount for printing in the waste toner reduction mode may be smaller than the disposal-scheduled toner amount or may be larger than the disposal-scheduled toner amount.

In a situation in which the toner consumption amount for printing in the waste toner reduction mode is smaller than the disposal-scheduled toner amount, the main control section 110 sets the operating mode of the printing section 2 as the toner disposal mode after printing is performed in the waste toner reduction mode. At the above time, the main control section 110 causes the printing section 2 to perform disposal of an amount of toner that is calculated by subtracting the toner consumption amount for printing in the waste toner reduction mode from the disposal-scheduled toner amount. On the other hand, in a situation in which the toner consumption amount for printing in the waste toner reduction mode is larger than the disposal-scheduled toner amount, the printing section 2 performs printing based on the prescribed image data using a larger amount of toner than the disposal-scheduled toner amount.

Figure 3:
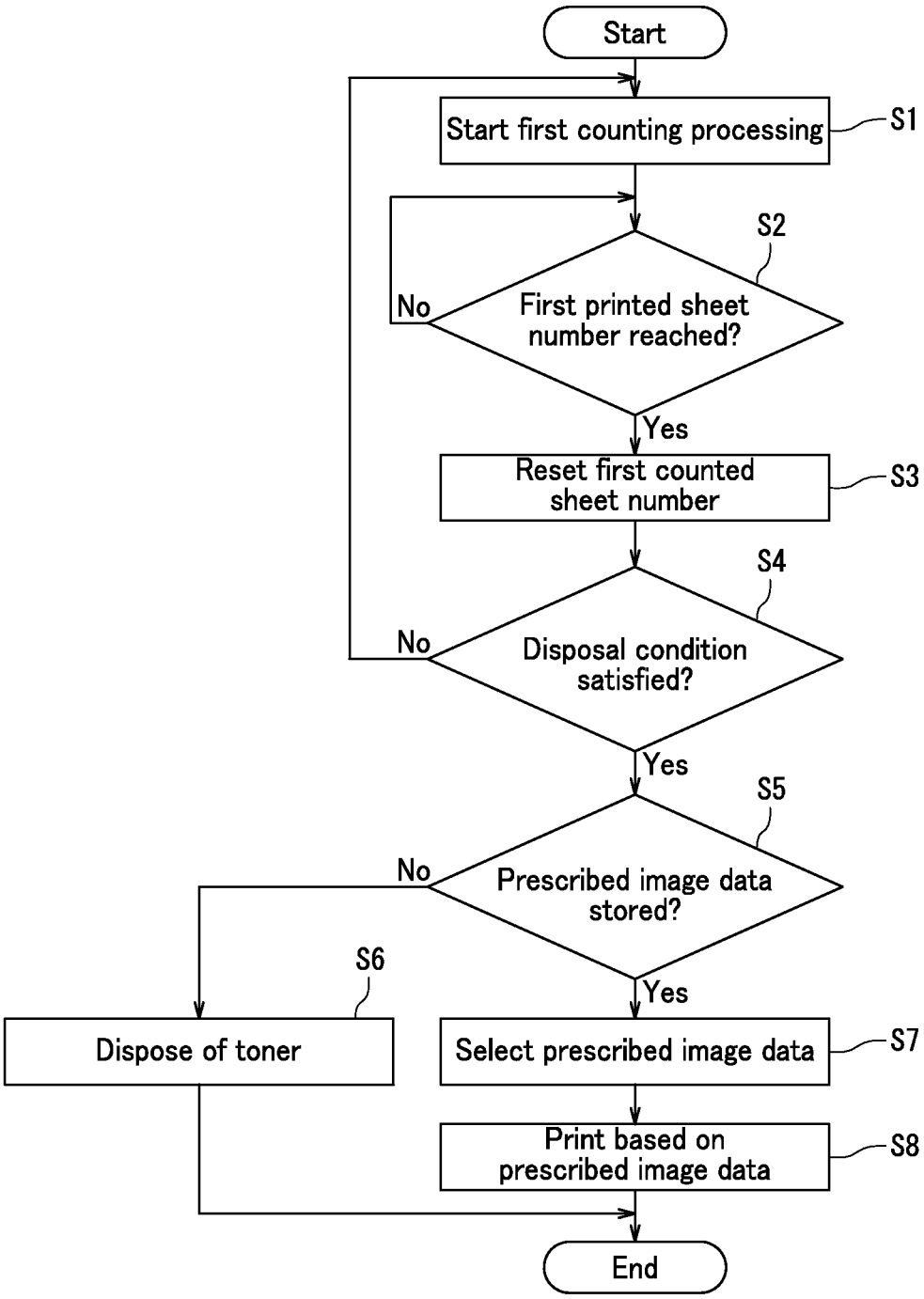
FIG. 3 is a flowchart illustrating control flow in the multifunction peripheral according to the embodiment of the present disclosure during printing in a waste toner reduction mode.

The following refers to the flowchart illustrated in FIG. 3 to explain control flow when printing is performed in the waste toner reduction mode. It should be noted that the flowchart in FIG. 3 starts upon printing starting for the first time in the normal printing mode once the multifunction peripheral 100 has started up or once the main control section 110 has performed the determination of whether or not the disposal condition is satisfied.

In Step S1, the main control section 110 starts the first counting processing of counting a printed sheet number in the normal printing mode. Next, in Step S2, the main control section 110 determines whether or not the first counted sheet number has reached the first printed sheet number. When a result of the determination is that the first counted sheet number has not reached the first printed sheet number, the main control section 110 repeats the determination in Step S2. In other words, the main control section 110 continues the first counting processing (i.e., does not reset the counted sheet number in the first counting processing).

Step S3 is performed next in a situation in which the main control section 110 determines that the first counted sheet number has reached the first printed sheet number in Step S2. In Step S3, the main control section 110 resets the first counted sheet number. Next, in Step S4, the main control section 110 determines whether or not the disposal condition is satisfied. Step S5 is performed next in a situation in which the main control section 110 determines that the disposal condition is satisfied as a result of Step S4. On the other hand, Step S1 is performed next in a situation in which the main control section 110 determines that the disposal condition is not satisfied.

In Step S5, the main control section 110 determines whether or not prescribed image data is stored in the storage section 130. Step S6 is performed next in a situation in which the main control section 110 determines that prescribed image data is not stored in the storage section 130 as a result of Step S5. In Step S6, the main control section 110 causes the printing section 2 to transition to the toner disposal mode. In other words, the printing section 2 disposes of disposal-scheduled toner as waste toner.

Step S7 is performed next in a situation in which the main control section 110 determines that prescribed image data is stored in the storage section 130 in Step S5. In Step S7, the main control section 110 selects one or more pieces of prescribed image data as a printing target from among the prescribed image data stored in the storage section 130 such that the toner consumption amount for printing in the waste toner reduction mode is as close as possible to the disposal-scheduled toner amount.

Next, in Step S8, the main control section 110 sets the operating mode of the printing section 2 as the waste toner reduction mode. In other words, the printing section 2 performs printing based on the prescribed image data that the main control section 110 selects as the printing target.

The main control section 110 may set the operating mode of the printing section 2 as the waste toner reduction mode even when the printed sheet number in the normal printing mode has not reached the first printed sheet number. More specifically, the main control section 110 performs second counting processing within a counting period that spans from a time at which the first counting processing starts until a time at which the first printed sheet number is reached. The second counting processing involves counting a printed sheet number starting from an initial point that is a specific time within the counting period of the first counting processing. In the present description, the specific time at which the second counting processing starts is the same as the time at which the first counting processing starts. However, no particular limitations are placed on the specific time at which the second counting processing starts so long as the specific time is within the counting period spanning from the time at which the first counting processing starts until the time at which the first printed sheet number is reached.

When the counted sheet number in the second counting processing (referred to below as a second counted sheet number) reaches a second printed sheet number, the main control section 110 obtains an average value (referred to below as a second coverage ratio) of coverage ratios of pages printed during the second counting processing up until the second printed sheet number is reached. The second printed sheet number is a smaller number of sheets than the first printed sheet number. Although no particular limitations are placed on the second printed sheet number, the second printed sheet number is for example on the order of several sheets or tens of sheets (for example, half of the first printed sheet number) and should be smaller than the first printed sheet number.

The main control section 110 determines whether or not the second coverage ratio is smaller than a preset second threshold value (for example, the same value as the first threshold value). Upon determining that the second coverage ratio is smaller than the second threshold value, the main control section 110 determines whether or not prescribed image data is stored in the storage section 130. In a situation in which the main control section 110 determines that prescribed image data is stored in the storage section 130, the main control section 110 sets the operating mode of the printing section 2 as the waste toner reduction mode, even if the first counted sheet number has not reached the first printed sheet number. In other words, in a situation in which the second coverage ratio is smaller than the second threshold value and in which prescribed image data is stored in the storage section 130, the printing section 2 performs printing based on the prescribed image data.

In the above situation, the main control section 110 selects prescribed image data as a printing target from among the prescribed image data stored in the storage section 130. More specifically, when the second counted sheet number reaches the second printed sheet number, the main control section 110 obtains an amount of toner for which disposal in currently required based on the second coverage ratio. The main control section 110 selects one or more pieces of prescribed image data as a printing target from among the prescribed image data stored in the storage section 130 such that the toner consumption amount for printing in the waste toner reduction mode is as close as possible to the amount of toner for which disposal is currently required.

It should be noted that the main control section 110 may perform a determination of whether or not to perform printing in the waste toner reduction mode a plurality of times within the counting period of the first counting processing. More specifically, the main control section 110 resets the second counted sheet number once the second counted sheet number reaches the second printed sheet number. The main control section 110 subsequently repeats the second counting processing until the first counted sheet number reaches the first printed sheet number and obtains the second coverage ratio each time the second counted sheet number reaches the second printed sheet number. In a situation in which the second coverage ratio is smaller than the second threshold value and in which prescribed image data is stored in the storage section 130, the main control section 110 sets the operating mode of the printing section 2 as the waste toner reduction mode.

<Notification about Printing Using Disposal-Scheduled Toner>

Upon determining that the disposal condition is satisfied, the main control section 110 performs processing for notifying a user that printing can be performed using the disposal-scheduled toner.

Figure 4:
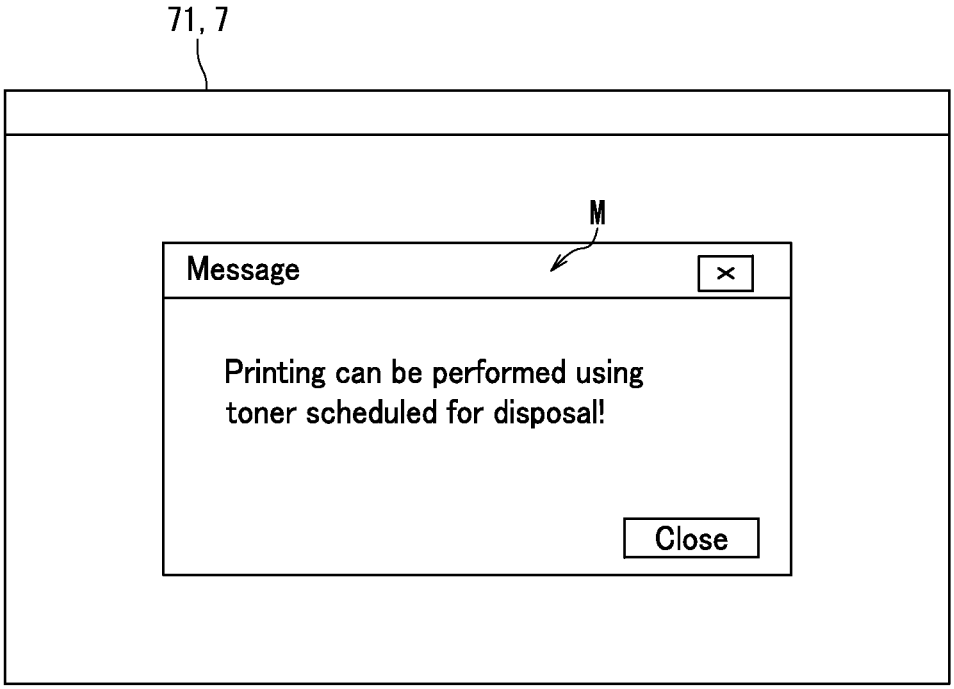
FIG. 4 illustrates a message displayed in the multifunction peripheral according to the embodiment of the present disclosure when notification is performed to indicate that printing can be performed using disposal-scheduled toner.

For example, the main control section 110 instructs the operation panel 7 to perform notification to indicate that printing can be performed using the disposal-scheduled toner. During notification, the operation panel 7 displays a message M, as illustrated in FIG. 4, for notifying that printing can be performed using the disposal-scheduled toner. In other words, the operation panel 7 functions as a notification section that notifies the user that printing can be performed using the disposal-scheduled toner.

Alternatively, the main control section 110 instructs the communication section 120 to transmit notification information to the user terminal 200 for notifying that printing can be performed using the disposal-scheduled toner. Upon receiving the notification information from the multifunction peripheral 100, the user terminal 200 displays a message notifying that printing can be performed using the disposal-scheduled toner (although not illustrated, the message is the same as the message M illustrated in FIG. 4). In other words, the user terminal 200 functions as an external notification device that notifies the user that printing can be performed using the disposal-scheduled toner.

Once the user has been notified that printing can be performed using the disposal-scheduled toner, the user can register, as prescribed image data, image data for which the user permits printing using the disposal-scheduled toner. For example, the user uses the multifunction peripheral 100 to read a document and registers image data of the document, which is obtained through the reading, as prescribed image data. Alternatively, the user transmits image data from the user terminal 200 to the multifunction peripheral 100 and registers the transmitted image data as prescribed image data.

In order that registration of prescribed image data by the user can be received, the main control section 110 causes the printing section 2 to remain on standby until a specific time has elapsed from notifying the user that printing can be performed using the disposal-scheduled toner. In other words, the printing section 2 does not perform toner disposal or printing using the disposal-scheduled toner until the specific time has elapsed.

When reading of a document by the image reading section 1 is performed before the specific time has elapsed from notifying the user that printing can be performed using the disposal-scheduled toner, the main control section 110 causes the storage section 130 to store image data of the document, which is obtained through the reading by the image reading section 1, as prescribed image data. Alternatively, when image data is received from the user terminal 200 by the communication section 120 before the specific time has elapsed from notifying the user that printing can be performed using the disposal-scheduled toner, the main control section 110 causes the storage section 130 to store the received image data as prescribed image data. The main control section 110 subsequently causes the printing section 2 to perform printing based on the image data obtained through document reading by the image reading section 1 or based on the image data received from the user terminal 200 by the communication section 120.

In a configuration such as described above, the notification enables the user to register prescribed image data even in a situation in which prescribed image data is not registered at the time at which the disposal condition is satisfied. Consequently, printing can be performed based on the prescribed image data and the amount of toner that is disposed of as waste toner without being used for printing can be reduced. The user preferably registers prescribed image data upon receiving notification that printing can be performed using the disposal-scheduled toner. Therefore, the configuration described above has favorable usability because it is not necessary for the user to register prescribed image data in advance.

A situation may arise in which prescribed image data is already stored in the storage section 130 at the time at which the disposal condition is satisfied. In such a situation, the main control section 110 for example causes the printing section 2 to preferentially perform printing based on image data that is acquired after the user is notified. Alternatively, the control section 110 may only perform processing for notifying the user in a situation in which prescribed image data is not stored in the storage section 130 at the time at which the disposal condition is satisfied.

Figure 5:
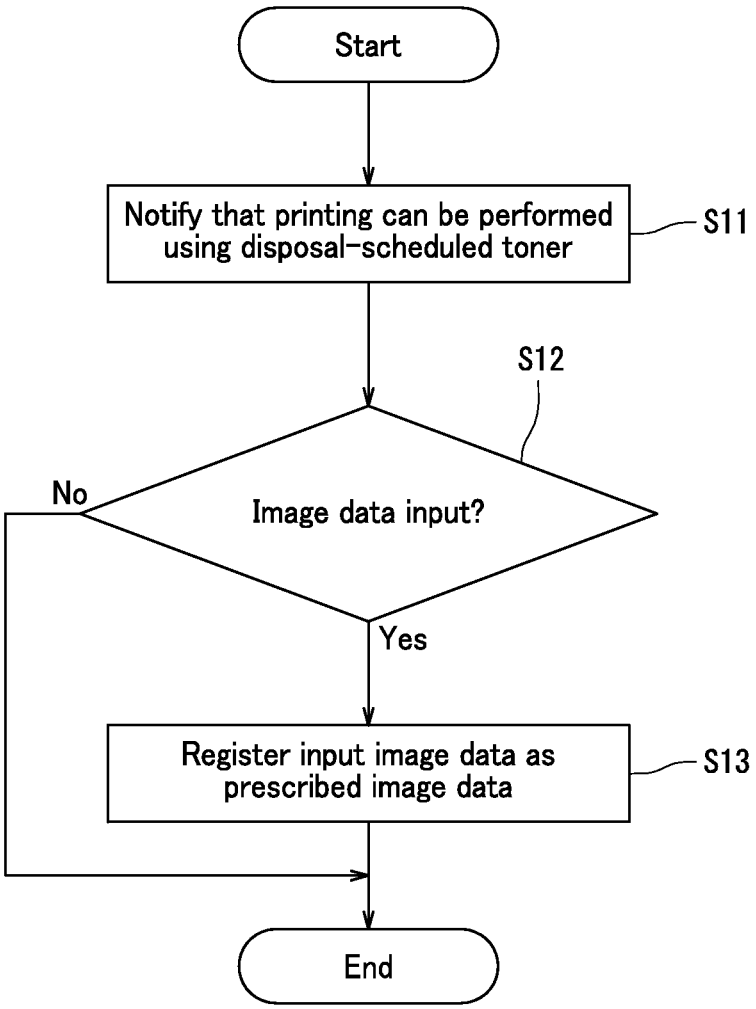
FIG. 5 is a flowchart illustrating control flow in the multifunction peripheral according to the present disclosure when registration of prescribed image data is received.

The following provides an explanation following the flowchart illustrated in FIG. 5. The flowchart illustrated in FIG. 5 starts when the disposal condition is satisfied.

In Step S11, the main control section 110 instructs the operation panel 7 to perform notification that printing can be performed using the disposal-scheduled toner (i.e., causes the operation panel to display a message such as the message M illustrated in FIG. 4). Alternatively, the main control section 110 instructs the communication section 120 to transmit notification information to the user terminal 200 for notifying that printing can be performed using the disposal-scheduled toner (i.e., causes the user terminal 200 to perform notification that printing can be performed using the disposal-scheduled toner).

Next, in Step S12, the main control section 110 determines whether or not image data is input before the specific time elapses. More specifically, when the multifunction peripheral 100 is used to read a document before the specific time elapses, the main control section 110 determines that image data is input (i.e., image data obtained through reading of the document). Alternatively, when image data is received from the user terminal 200 before the specific time elapses, the main control section 110 determines that image data is input (i.e., the image data received from the user terminal 200). Step S13 is performed next in a situation in which the main control section 110 determines that image data is input.

In Step S13, the main control section 110 newly registers the image data input before the specific time elapses as prescribed image data. In the above situation, the newly registered prescribed image data is added as a selection option in Step S7 of the flowchart illustrated in FIG. 3 in which the main control section 110 selects prescribed image data as a printing target.

The flowchart illustrated in FIG. 5 ends in a situation in which the main control section 110 determines that image data is not input in Step S12. In the above situation, the main control section 110 selects prescribed image data as a printing target in Step S7 of the flowchart illustrated in FIG. 3 from among prescribed image data that is already registered.

<Prescribed Image Data Registration for Multifunction Peripherals in Image Forming System>

Prescribed image data can be registered in the plurality of multifunction peripherals 100 included in the image forming system 100S. More specifically, each of the plurality of the multifunction peripherals 100 can store data depicting the same image as prescribed image data in the storage section 130 thereof. Furthermore, in a situation in which each of the plurality of the multifunction peripherals 100 stores data depicting the same image (also referred to as identical image data), printing based on the identical image data is performed by a multifunction peripheral 100 among the plurality of multifunction peripheral 100 for which the operating mode of the printing section 2 therein is first set as the waste toner reduction mode.

Figure 6:
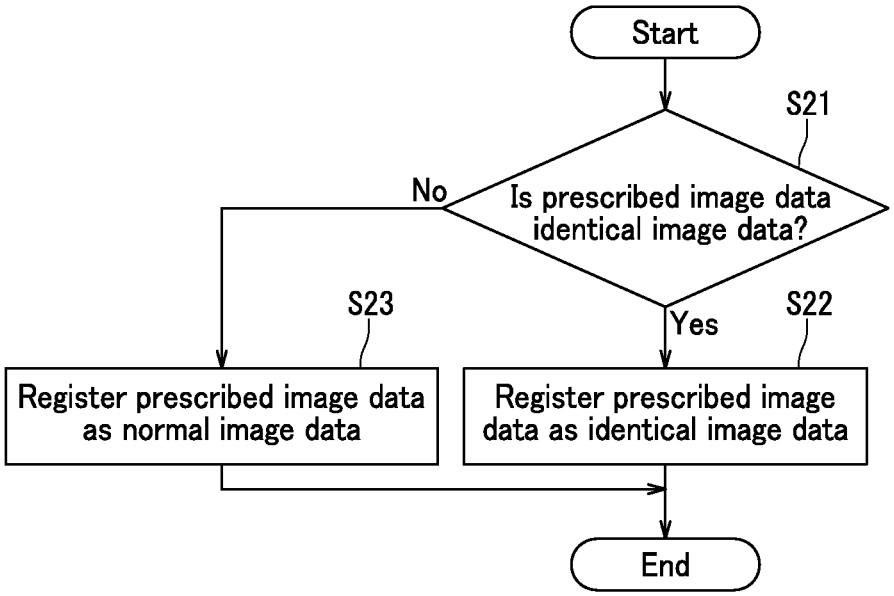
FIG. 6 is a flowchart illustrating control flow in an image forming system according to the embodiment of the present disclosure when identical image data is registered as prescribed image data.

The flowing provides an explanation following the flowchart illustrated in FIG. 6. The flowchart illustrated in FIG. 6 starts when the multifunction peripheral 100 receives registration of prescribed image data.

In Step S21, the main control section 110 determines whether or not the prescribed image data that is a registration target is identical image data. For example, the main control section 110 refers to information in print data that includes the prescribed image data. Information that indicates whether the prescribed image data is identical image data is included in the print data including the prescribed image data. Information indicating that the prescribed image data is identical image data can for example be included in the print data through a preset operation performed on the operation panel 7 or the user terminal 200. Step S22 is performed next in a situation in which the main control section 110 determines that the registration target prescribed image data is identical image data in Step S21. On the other hand, Step S23 is performed next in a situation in which the main control section 110 determines that the registration target prescribed image data is not identical image data.

In Step S22, the main control section 110 registers the registration target prescribed image data as identical image data. After the above, for example, the main control section 110 of a multifunction peripheral 100 for which the operating mode of the printing section 2 therein is first set as the waste toner reduction mode preferentially selects the identical image data as a printing target in Step S7 of the flowchart illustrated in FIG. 3 from among prescribed image data stored in the storage section 130. On the other hand, in Step S23, the main control section 110 registers the registration target prescribed image data as normal prescribed image data (i.e., not as identical image data).

In the above configuration, the same prescribed image data is registered in the plurality of the multifunction peripherals 100. Therefore, it is possible to avoid an inconvenient situation in which it takes a long time to obtain printed matter based on the prescribed image data.

After printing has been performed based on identical image data in a given one of the multifunction peripherals 100 (denoted "multifunction peripheral 100A"), it is not necessary to perform printing based on the identical image data in the other multifunction peripherals 100 (denoted "multifunction peripherals 100B"). Therefore, after the multifunction peripheral 100A has performed printing based on the identical image data, the multifunction peripheral 100A for example notifies the user terminal 200 that performed registration of the identical image data that printing based on the identical image data is complete. In response to the above, the user deletes the identical image data stored in the multifunction peripherals 100B. Alternatively, after the multifunction peripheral 100A has performed printing based on the identical image data, the multifunction peripheral 100A may transmit a data deletion request for the identical image data to the multifunction peripherals 100B. In another alternative example, the multifunction peripheral 100A may transmit a notification that printing is complete to the user terminal 200 and also transmit a data deletion request to the multifunction peripherals 100B.

Figure 7:
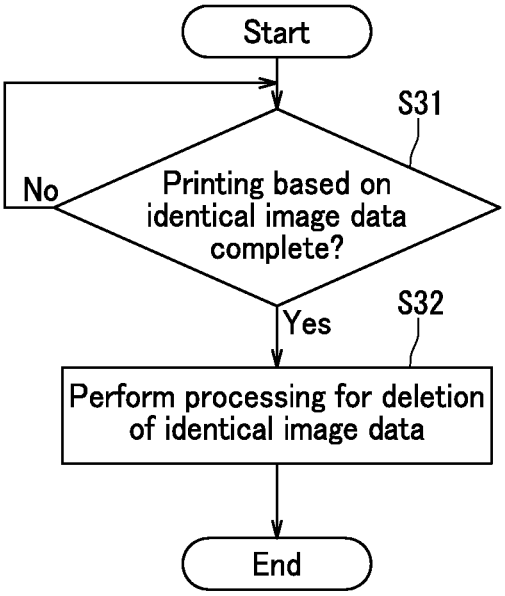
FIG. 7 is a flowchart illustrating control flow in the image forming system according to the embodiment of the present disclosure when the identical image data is deleted.

The following provides an explanation following the flowchart illustrated in FIG. 7. The flowchart illustrated in FIG. 7 starts when the multifunction peripheral 100A performs printing based on the identical image data.

In Step S31, the main control section 110 of the multifunction peripheral 100A determines whether or not printing based on the identical image data is complete. Step S32 is performed next in a situation in which a result of Step S31 is that printing based on the identical image data is complete, whereas the determination in Step S31 is repeated in a situation in which the result of Step S31 is that printing based on the identical image data is not complete.

In Step S32, the main control section 110 of the multifunction peripheral 100A performs processing for deleting the identical image data registered in the multifunction peripherals 100B. In other words, the main control section 110 of the multifunction peripheral 100A instructs the communication section 120 to transmit a printing completion notification to the user terminal 200 that performed the registration of the identical image data, indicating that printing based on the identical image data has been performed. Alternatively, the main control section 110 of the multifunction peripheral 100A instructs the communication section 120 to transmit a data deletion request for the identical image data to the multifunction peripherals 100B.

As described above, the multifunction peripheral 100 according to the present embodiment includes the printing section 2, the storage section 130, and the main control section 110. The printing section 2 includes the photosensitive drum 51 (image bearing member), the developing device 54, and the cleaning device 56. The printing section 2 prints a toner image on paper P. The photosensitive drum 51 has a surface on which an electrostatic latent image is formed based on image data. The developing device 54 supplies toner onto the surface of the photosensitive drum 51 and develops the electrostatic latent image into the toner image. The cleaning device 56 removes residual toner from the surface of the photosensitive drum 51. The storage section 130 stores prescribed image data for which printing is permitted using disposal-scheduled toner that is scheduled for disposal as waste toner. The main control section 110 determines whether or not a preset disposal condition is satisfied. Upon determining that the disposal condition is satisfied, the main control section 110 determines whether or not prescribed image data is stored in the storage section 130. Upon determining that prescribed image data is not stored in the storage section 130, the main control section 110 sets the operating mode of the printing section 2 as the toner disposal mode in which the developing device 54 performs enforced discharge of the disposal-scheduled toner onto the surface of the photosensitive drum 51 and the cleaning device 56 removes the disposal-scheduled toner from the photosensitive drum 51. Upon determining that prescribed image data is stored in the storage section 130, the main control section 110 sets the operating mode of the printing section 2 as the waste toner reduction mode in which the printing section 2 uses the disposal-scheduled toner to perform printing based on the prescribed image data.

In the configuration of the present embodiment, image data for which printing is permitted using disposal-scheduled toner (prescribed image data) can be registered. Consequently, in a situation in which prescribed image data is currently registered at a time at which toner is to be disposed of as waste toner, the operating mode of the printing section 2 is set as the waste toner reduction mode in which the disposal-scheduled toner is used to perform printing, rather than the toner disposal mode in which toner disposal is performed. In other words, the disposal-scheduled toner is used for printing based on the prescribed image data. The above configuration can reduce the amount of toner that is disposed of as waste toner.

In the present embodiment, as described above, in a situation in which the operating mode of the printing section 2 is set as the waste toner reduction mode, the main control section 110 selects one or more pieces of prescribed image data as a printing target from among the prescribed image data stored in the storage section 130 such that the toner consumption amount during printing in the waste toner reduction mode is as close as possible to the disposal-scheduled toner amount. The printing section 2 then performs printing based of the prescribed image data that the main control section 110 selects. Consequently, the disposal-scheduled toner can be efficiently used for printing (i.e., the majority of the disposal-scheduled toner can be used for printing).

In the present embodiment, as described above, the main control section 110 performs the first counting processing of counting a printed sheet number in the normal printing mode. The main control section 110 performs the determination of whether or not the disposal condition is satisfied once the first counted sheet number reaches the preset first printed sheet number. During the determination, the main control section 110 obtains a first coverage ratio representing an average value of coverage ratios for pages printed during the first counting processing up until the first printed sheet number is reached. In a situation in which the first coverage ratio is smaller than the first threshold value, the main control section 110 determines that the disposal condition is satisfied and sets the operating mode of the printing section 2 as the toner disposal mode or the waste toner reduction mode. In the first counting processing, the first coverage ratio is small in a situation in which printing is repeatedly performed with a small coverage ratio. By determining whether or not the disposal condition is satisfied based on the first coverage ratio, the operating mode of the printing section 2 can therefore be set as the waste toner reduction mode when printing is repeatedly performed with a small coverage ratio.

In the present embodiment, as described above, the main control section 110 performs the second counting processing of counting a printed sheet number within the counting period of the first counting processing, starting from an initial point that is a specific time within the counting period. When the second counted sheet number reaches the second printed sheet number, the main control section 110 obtains a second coverage ratio representing an average value of coverage ratios of pages printed during the second counting processing up until the second printed sheet number is reached. In a situation in which the second coverage ratio is smaller than the second threshold value and in which prescribed image data is stored in the storage section 130, the main control section 110 sets the operating mode of the printing section 2 as the waste toner reduction mode, even if the counted sheet number in the first counting processing has not reached the first printed sheet number. Consequently, printing can be performed based on the prescribed image data in a situation in which toner disposal is required due to, for example, repeated printing with a small coverage ratio, even if the number of sheets printed in the normal printing mode has not yet reached the first printed sheet number.

The presently disclosed embodiment is merely provided as an illustrative example in all aspects and should not be considered to be limiting. The scope of the present disclosure is indicated by the claims rather than the explanation of the above embodiment and further includes all alterations that are equivalent in meaning and scope to the claims.

What is claimed is:

1. An image forming apparatus comprising:

a printing section configured to print a toner image on paper and including an image bearing member having a surface on which an electrostatic latent image is formed based on image data, a developing device that supplies toner onto the surface of the image bearing member and develops the electrostatic latent image into the toner image, and a cleaning device that removes residual toner from the surface of the image bearing member;

a storage section configured to store prescribed image data for which printing is permitted using disposal-scheduled toner that is scheduled for disposal as waste toner; and a control section configured to determine whether or not a preset disposal condition is satisfied, the control section, upon determining that the disposal condition is satisfied, determining whether or not prescribed image data is stored in the storage section, upon determining that prescribed image data is not stored in the storage section, setting an operating mode of the printing section as a toner disposal mode in which the developing device performs enforced discharge of the disposal-scheduled toner onto the surface of the image bearing member and the cleaning device removes the disposal-scheduled toner from the image bearing member, and upon determining that prescribed image data is stored in the storage section, setting the operating mode of the printing section as a waste toner reduction mode in which the printing section uses the disposal-scheduled toner to perform printing based on the prescribed image data.

2. The image forming apparatus according to claim 1, wherein in a situation in which the operating mode of the printing section is set as the waste toner reduction mode, the control section selects one or more pieces of prescribed image data as a printing target from among the prescribed image data stored in the storage section such that an amount of toner consumed by printing in the waste toner reduction mode is as close as possible to an amount of toner for which disposal is currently required, and the printing section performs printing based on the prescribed image data that the control section selects.

3. The image forming apparatus according to claim 1, wherein the control section performs first counting processing of counting a printed sheet number in a normal printing mode that differs from the waste toner reduction mode and the toner disposal mode, determines whether or not the disposal condition is satisfied when the printed sheet number counted in the first counting processing reaches a preset first printed sheet number, and when determining whether or not the disposal condition is satisfied, obtains a first coverage ratio representing an average value of coverage ratios of pages printed during the first counting processing up until the first printed sheet number is reached, and in a situation in which the first coverage ratio is less than a preset first threshold value, determines that the disposal condition is satisfied and sets the operating mode of the printing section as the toner disposal mode or the waste toner reduction mode.

4. The image forming apparatus according to claim 3, wherein the control section performs second counting processing of counting a printed sheet number within a counting period that spans from a time at which the first counting processing starts until a time at which the printed sheet number counted in the first counting processing reaches the first printed sheet number, starting from an initial point that is a specific time within the counting period, upon the printed sheet number counted in the second counting processing reaching a second printed sheet number that is smaller than the first printed sheet number, obtains a second coverage ratio representing an average value of coverage ratios of pages printed during the second counting processing up until the second printed sheet number is reached, determines whether or not prescribed image data is stored in the storage section in a situation in which the second coverage ratio is less than a preset second threshold value, and upon determining that prescribed image data is stored in the storage section, sets the operating mode of the printing section as the waste toner reduction mode.

5. The image forming apparatus according to claim 1, further comprising a notification section configured to perform notification to indicate that printing can be performed using the disposal-scheduled toner, wherein the control section, upon determining that the disposal condition is satisfied, causes the notification section to perform the notification, upon receiving image data before a specific time elapses from the notification section performing the notification, causes the storage section to store the image data as prescribed image data, and sets the operating mode of the printing section as the waste toner reduction mode.

6. The image forming apparatus according to claim 5, further comprising a communication section configured to communicate with a user terminal, wherein upon receiving image data from the user terminal before the specific time elapses from the notification section performing the notification, the control section causes the storage section to store the image data received from the user terminal as prescribed image data.

7. The image forming apparatus according to claim 5, further comprising an image reading section configured to generate image data of a document by reading the document, wherein upon receiving the image data generated by the image reading section before the specific time elapses from the notification section performing the notification, the control section causes the storage section to store the image data generated by the image reading section as prescribed image data.

8. An image forming system comprising a plurality of image forming apparatuses according to claim 1, wherein the image forming apparatuses are communicable with one another, the storage sections of the image forming apparatuses each store, as prescribed image data, data depicting the same image, and among the image forming apparatuses, an image forming apparatus for which the operating mode of the printing section therein is first set as the waste toner reduction mode performs printing based on the data depicting the same image and performs processing to delete data depicting the same image as the printed image from the storage sections of the other image forming apparatuses.

* * * * *